US006234642B1

(12) United States Patent
Bokämper

(10) Patent No.: US 6,234,642 B1
(45) Date of Patent: May 22, 2001

(54) BED WITH IMPROVED LIGHTING FEATURES

(75) Inventor: Ralf Bokämper, Lübbecke (DE)

(73) Assignee: Dewert Antriebs- und Systemtechnik GmbH & Co. KG, Kirchlengern (DE)

( * ) Notice: Subject to any disclaimer, the term of this patent is extended or adjusted under 35 U.S.C. 154(b) by 0 days.

(21) Appl. No.: 09/288,925

(22) Filed: Apr. 9, 1999

(30) Foreign Application Priority Data

Apr. 15, 1998 (DE) ..... 298 06 588 U

(51) Int. Cl.[7] ..... A47B 23/06
(52) U.S. Cl. ..... 362/130; 5/905
(58) Field of Search ..... 362/130, 800, 362/551, 802, 276; 5/905

(56) References Cited

U.S. PATENT DOCUMENTS 3,728,606 * 4/1973 Finnegan et al. ..... 5/63
4,472,845 * 9/1984 Chivetta et al. ..... 5/63
4,947,298 * 8/1990 Stephen ..... 362/130
5,307,051 * 4/1994 Sedmayr ..... 340/573
5,422,623 * 6/1995 Bader ..... 362/35
5,644,291 * 7/1997 Jozwik ..... 362/493
5,743,635 * 4/1998 Husle et al. ..... 362/385
5,802,640 * 9/1998 Ferrand et al. ..... 5/617

* cited by examiner

*Primary Examiner*—Thomas M. Sember
(74) *Attorney, Agent, or Firm*—Henry M. Feiereisen

(57) ABSTRACT

A hospital bed or nursing bed has movable components which can be adjusted by a drive including a plastic casing and an electric motor accommodated in the casing. A control block is operatively connected to the drive and includes a circuit board for the control of the electric motor. In order to realize a night light when the lighting of the room is switched off, without significant modification of the plastic casing, a light source is provided which is connected to an electrically conductive pathway of the circuit board. The light source is suitably disposed inside the casing and directly placed onto the electrically conductive pathway of the circuit board. Juxtaposed to the light source is a luminescent rod or light-conducting rod penetrating a wall or lid of the casing for transmitting light rays radiating from the light source.

43 Claims, 2 Drawing Sheets

BED WITH IMPROVED LIGHTING FEATURES

CROSS-REFERENCES TO RELATED APPLICATIONS

This application claims the priority of German Patent Application Serial No. 298 06 588.6, filed Apr. 15, 1998, the subject matter of which is incorporated herein by reference.

BACKGROUND OF THE INVENTION

The present invention relates, in general, to a bed, and more particularly to a hospital bed or nursing bed of a type including a frame with movable components which are adjustable by at least one electric motor accommodated in a casing and actuated by a control block which includes a printed circuit board and is disposed within the casing or externally onto the casing or separately from the casing.

Hospital beds or nursing beds are known in many designs. Oftentimes, the patient is incapable to adjust the frame, for example the leg portion or the back portion so that the adjustment must be carried out by the nursing staff. Therefore, beds are increasingly in demand which are equipped with drives to adjust the movable components so that the patient is only required to operate a hand switch to initiate the adjustment whereby certain functions, in particular those provided for therapy are triggered solely by the nursing staff.

The drive or drives are designed to best suit the required operations. Typically, hospitals or nursing homes place several beds in a single room. While each bed is equipped with a reading lamp, in situations when the patient needs to get up during nighttime and thus the lighting for the room is turned off, it is normally necessary for another person that is not bed-ridden to switch on the reading lamp. In addition, other patients in the room may become annoyed when a reading lamp is turned on during nighttime for a patient to leave the bed. Still, it is necessary to illuminate the respective area around the bed to allow a patient to safely leave the bed and subsequently get back into the bed. While it is conceivable to install a night lamp underneath the bed frame securely fix it thereto, it is still necessary, regardless of its configuration, to connect the lamp to an electric wall outlet via a fixed or loose cable. The presence of such a cable is, however, annoying in particular during daily cleaning works.

SUMMARY OF THE INVENTION

It is thus an object of the present invention to provide an improved bed, obviating the afore-stated drawbacks.

In particular, it is an object of the present invention to provide an improved bed which permits a night illumination of an adjoining bed area in a cost-efficient manner, when the room lighting is turned off.

These objects, and others which will become apparent hereinafter, are attained in accordance with the present invention by so combining a light source with the control block of a drive for adjustment of components of the bed frame that the light source is connected to an electrically conductive pathway of the circuit board within the control block for supply of electric power.

In accordance with the present invention, the power supply for the light source is now realized by the circuit board integrated in the control block for the drive mechanism. Thus, there is no need to route any additional cables or to use any annoying, loose cables. The casing of the drive mechanism, typically made of plastic material, does not require any modifications of the tools for manufacturing the casing of the control block. The illumination can be realized in a very simple manner. The light source can be appropriately placed that the area adjoining the bed becomes sufficiently illuminated for the patient to get safely into the bed. In the event such a placement is not possible, the light source may be designed in such a manner that the radiating light beam is directed to illuminate the area around the bed.

According to a feature of the present invention, the light source is disposed inside the casing of the control block and placed, preferably soldered, directly onto the electrically conductive pathway of the circuit board. This represents a simple solution and permits the light source to be attached to the electrically conductive pathway during production of the circuit board. Thus, no significant additional work is required for wiring the drive mechanism. It is only necessary to provide a respective opening in a wall or lid of the casing of the control block for passage of the light radiation. Normally, however, the circuit board is spaced at a distance to the wall or lid of the casing so that the provision of a bridging luminescent rod or light-conducting rod in immediate vicinity of the light source may be appropriate, with the rod penetrating an opening in the wall or lid of the casing for transmitting the light radiation to the area to be illuminated. These rods are very cheap. The opening for passage of the luminescent rod or light-conducting rod may have a funnel shaped configuration or truncated cone shaped configuration whereby the greater diameter faces the circuit board. Suitably, the luminescent rod or light-conducting rod is sealed against the opening by a gasket to prevent moisture or contaminants to penetrate into the interior of the casing of the control block.

In the event, the circuit board is positioned at a relatively small distance to the wall or lid of the casing, or immediately juxtaposed thereto, the provision of the luminescent rod or light-conducting rod may be omitted altogether. In this case, it is advantageous to place a lens in the opening of the casing to widen and scatter the light radiation. Typically, the lens is made of plastic, e.g. polycarbonate. During injection molding of the casing or lid for the control block, the lens can be placed into the mold and injection molded therewith. It is also possible to subsequently glue or insert the lens as a separate part in the opening.

According to another feature of the present invention, the light source is a light-emitting diode, regardless of the involved design of the control block, in order to radiate the light beam in a directed fashion.

The light source can be switched on in many ways. For example, a hand switch may be provided which is electrically connected to the circuit board. The use of a hand switch requires, however, the patient to actuate a particular push button key for operating the light source. The activation of the push button key may, however, be difficult in darkness. Therefore, it may be advantageous to combine the operation of the light source for example with an upward movement of the back portion, i.e. the light source is turned on when the back portion of the bed frame is elevated. This is attained by placing the light source in parallel with one of the drives for adjustment of components of the bed, so that starting of this drive results in a simultaneous illumination of the light source.

It is also possible to install a sensor within the mattress of the bed, for example a sensor which responds to weight changes, in order to switch on the light source. Such a weight change normally occurs when the patient moves to the upright position before leaving the bed so that a major portion of the body weight acts on the middle zone of the bed and is registered by the sensor to subsequently switch on the light source. Another possibility includes the use of a photocell or a contactless feeler for operating the light source. These components are installed at a location where the patient sits after rising from the recumbent position. Optionally, the light source may be coupled with a suitable control mechanism for switching on the light source with a time delay. By means of another control mechanism, the light source can be turned off after a set time delay.

In addition, all previously described variations may be equipped with a twilight switch which turns on the light source as soon as a certain degree of dimness is encountered. The circuit may however also be configured in such a manner that the light source continuously illuminates during darker periods by means of a twilight switch that operates as permanent light.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
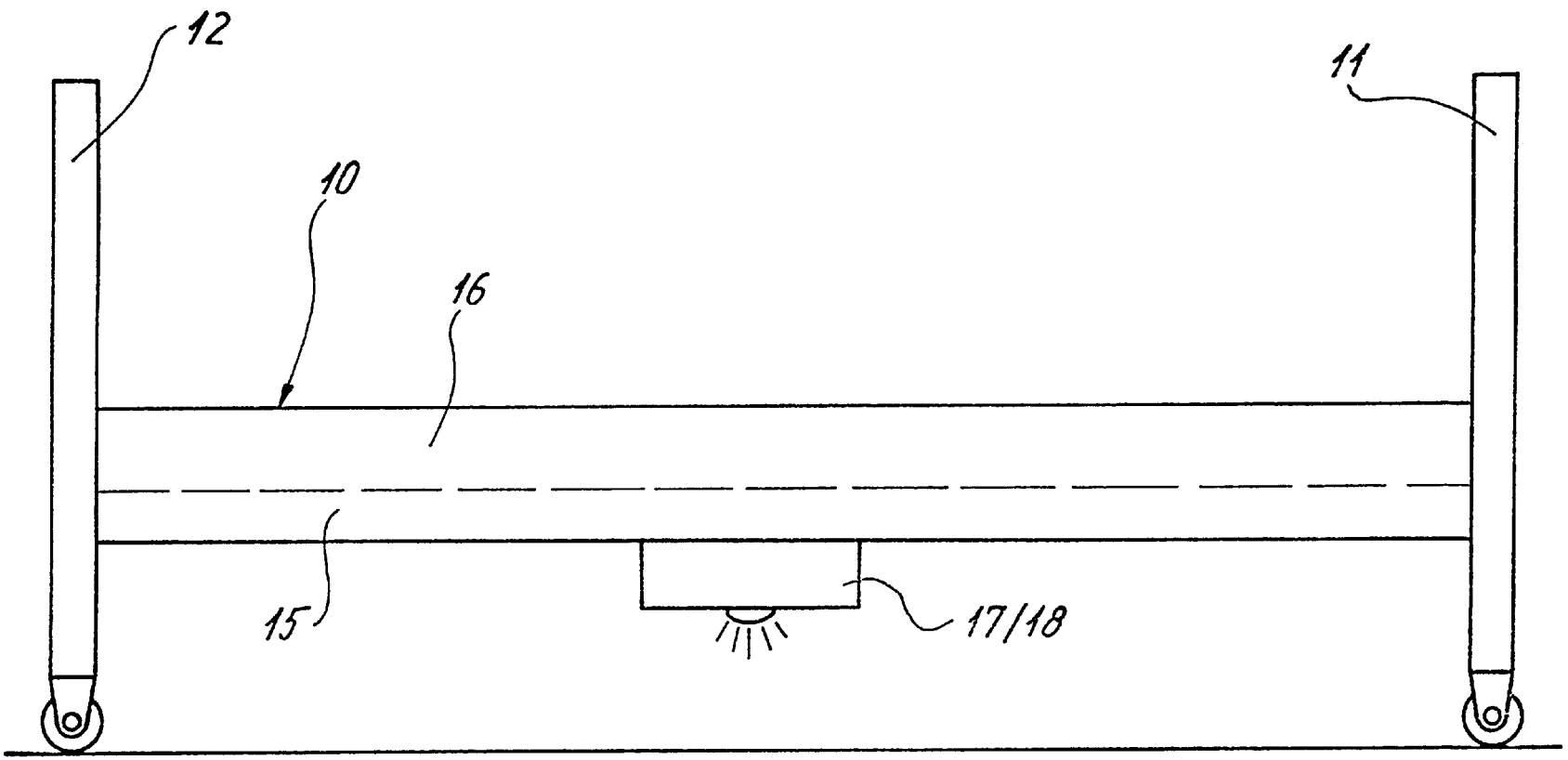
FIG 1 is a schematic side view of a hospital bed or nursing bed according to the present invention.

Throughout all the Figures, same or corresponding elements are generally indicated by same reference numerals.

Figure 2:
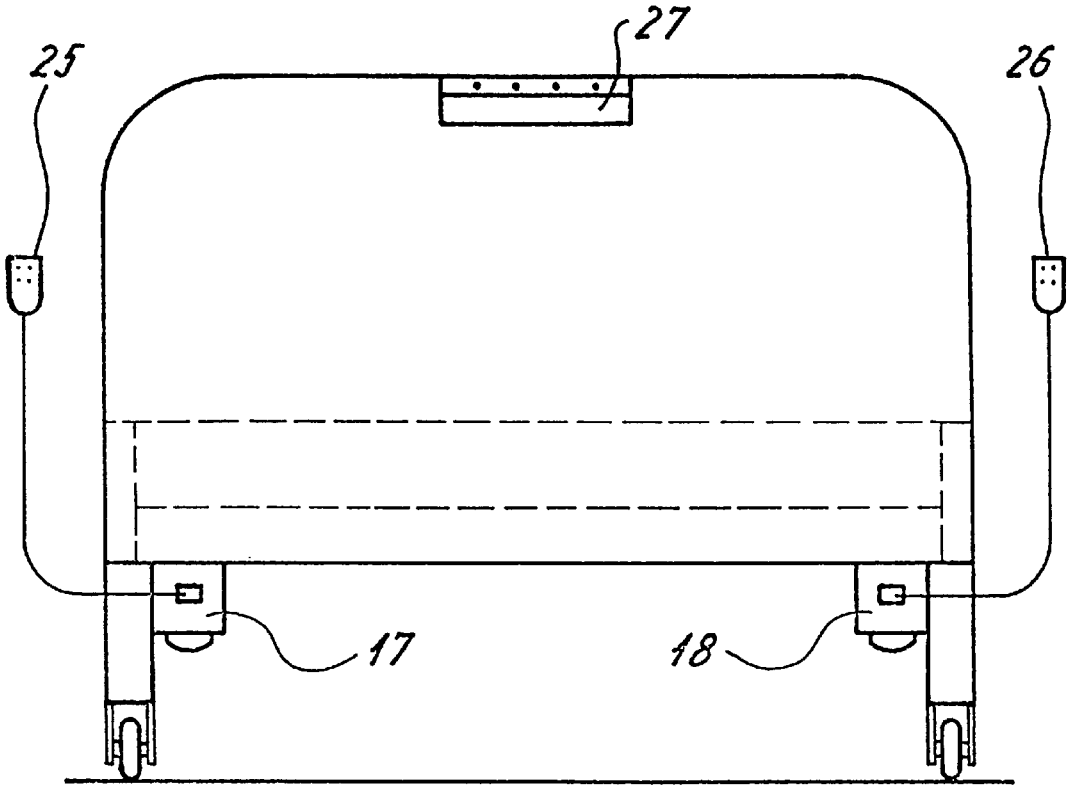
FIG. 2 is a plan view of the bed of FIG. 1.

Turning now to the drawing, and in particular to FIG. 1, there is shown a schematic side view of a bed, such as a hospital bed or nursing bed, according to the present invention, generally designated by reference numeral 10. The bed 10 has a frame essentially comprised of a head portion 11, a foot portion 12, side portions 13, 14 and a support 15 for placement of a mattress 16. Typically, the mattress support 15 is so designed as to be adjustable into various positions by incorporating one or more electric drives which are represented in FIGS. 1 and 2 by two exemplified control blocks 17, 18 for operation of the drives. Persons skilled in the art will understand that the control blocks 17, 18 may be accommodated inside respective plastic casings of the drives, or externally mounted to the drives, or even form components that are mounted separate from the drives.

Figure 3:
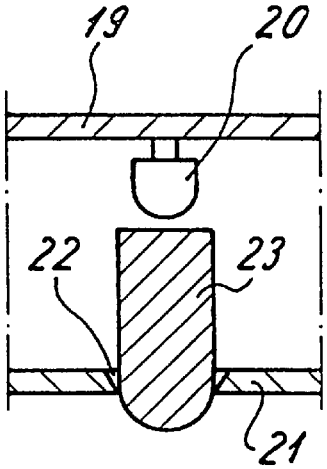
FIG. 3 is a first variation of arrangement of a light source in an exemplified control block for a drive to adjust the bed.
Figure 4:
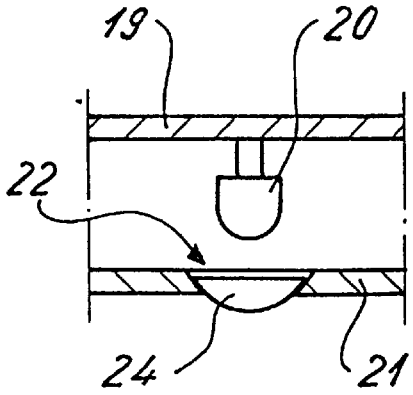
FIG. 4 is a second variation of arrangement of a light source in another exemplified control block.

Received inside each control block 17, 18 is a printed circuit board 19. Circuit boards of the type involved here are generally known and contain integrated circuit chips and connections for a variety of electronic components and are printed with electrically conductive pathways between the components. As shown in FIGS. 3 and 4, the circuit board 19 has mounted thereon a light source in the form of a light-emitting diode 20 which is attached directly e.g. soldered, onto the current carrying pathway (not shown) of the circuit board 19 and radiates light rays through an opposite opening 22 in a wall 21 of the respective casing of the control blocks 17, 18. The opening 22 has a funnel-shaped configuration, with the greater diameter facing the light source 20. The funnel-shaped configuration of the opening 22 is shown by way of example only, and may certainly be substituted by a truncated cone shaped configuration to attain the same desired results.

FIGS. 3 and 4 illustrate two exemplified variations of attachment of the light source 20 and realizing an illumination of a desired area, with the difference between the two variations residing in the different spacing between the light source 20 and the opposite wall 21 of the control block 17, 18. In FIG. 3, the distance of the light source 20 to the opposite wall 21 is greater than in FIG. 4. In order to bridge the distance between the light source 20 and the wall 21 and to ensure a proper emission of the light rays through the opening 22, when the variation of FIG. 3 is involved, a luminescent rod or light-conducting rod 23 is positioned in front of the light source 20. The rod 23 projects through the opening 22 beyond the wall 21 to thereby slightly jut outwards from the control block 17, 18 This ensures a targeted direction of light rays to the outside.

FIG. 4 illustrates a situation in which the spacing between the light source 20 and the opposite wall 21 is small so that the provision of a rod 23 is not dictated. However, in order to ensure an illumination of a sufficiently wide area, a lens 24 is placed in the opening 22 to attain a scattering of incident light rays from the light source 20, whereby the spacing between the light source 20 and the lens 24 is very small. Thus, a placement of the control blocks 17, 18 on both longitudinal sides of the bed 10 approximately in the middle between the head portion 11 and the foot portion 12, as shown in FIGS. 1 and 2, results in an illumination of the central region, i.e. the area which a person occupies when rising from the recumbent position.

As shown in FIG. 2, each control block 17, 18 may be operatively connected to a hand switch 25, 26 to allow the person to operate the integrated control mechanism. A further control element 27, e.g. a supervisor or a control box, is intended to be triggered only by the medical staff to execute particular operations of the bed 10.

While the invention has been illustrated and described as embodied in a bed with improved lighting features, it is not intended to be limited to the details shown since various modifications and structural changes may be made without departing in any way from the spirit of the present invention.

What is claimed as new and desired to be protected by Letters Patent is set forth in the appended claims:

1. A bed, comprising:

a frame having moveable components;

at least one drive for adjusting the components, said drive including a casing;

a control block, secured to the frame, for the control of the drive, said control block including a circuit board and being disposed at a location selected from the group consisting of inside the casing, mounted externally onto the casing, and separate from the casing; and a light source, connected to an electrically conductive pathway of the circuit board, for illuminating an area around the frame; and a luminescent rod juxtaposed to the light source and penetrating through an opening in a wall or lid of the casing for transmitting light rays radiating from the light source.

2. The bed of claim 1 wherein the light source is disposed inside the casing and directly placed onto the electrically conductive pathway of the circuit board.

3. The bed of claim 2 wherein the light source is soldered onto the pathway of the circuit board.

4. The bed of claim 1, and further comprising a gasket for sealing the luminescent rod in the opening.

5. The bed of claim 1, and further comprising a lens disposed in the opening.

6. The bed of claim 1 wherein the opening has a configuration selected from the group consisting of funnel-shape or truncated cone shape, thereby defining a diameter of greater dimension which faces the circuit board.

7. The bed of claim 1 wherein the light source is a light-emitting diode.

8. The bed of claim 1, and further comprising a hand switch electrically connected to the circuit board, said light source being operated by the hand switch.

9. The bed of claim 1 wherein the light source is connected in parallel with the drive for adjustment of components of the frame.

10. The bed of claim 1, and further comprising an element selected from the group consisting of photocell and contactless feeler, said light source being switched by the element.

11. The bed of claim 1, and further comprising an electronic circuit for operating the light source with a time delay.

12. The bed of claim 1, and further comprising an electronic circuit for shutting down the light source at a set time delay.

13. The bed of claim 1, and further comprising a twilight switch for controlling operation of the light source.

14. The bed of claim 1, and further comprising a twilight switch for switching on the light source as steady light.

15. A bed, comprising:

a frame having moveable components and a support for a mattress;

at least one drive for adjusting the components, said drive including a casing;

a control block, secured to the frame, for the control of the drive, said control block including a circuit board and being disposed at a location selected from the group consisting of inside the casing, mounted externally onto the casing, and separate from the casing; and a light source, connected to an electrically conductive pathway of the circuit board, for illuminating an area around the frame; and a sensor disposed in the mattress, said light source being operated by the sensor.

16. The bed of claim 15 wherein the sensor is a sensor responding to weight changes.

17. The bed of claim 15 wherein the light source is disposed inside the casing and directly placed onto the electrically conductive pathway of the circuit board.

18. The bed of claim 17 wherein the light source is soldered onto the pathway of the circuit board.

19. The bed of claim 15 wherein the light source is a light-emitting diode.

20. The bed of claim 15, and further comprising a hand switch electrically connected to the circuit board, said light source being operated by the hand switch.

21. The bed of claim 15 wherein the light source is connected in parallel with the drive for adjustment of components of the frame.

22. The bed of claim 15, and further comprising an element selected from the group consisting of photocell and contactless feeler, said light source being switched by the element.

23. The bed of claim 15, and further comprising an electronic circuit for operating the light source with a time delay.

24. The bed of claim 15, and further comprising an electronic circuit for shutting down the light source at a set time delay.

25. The bed of claim 15, and further comprising a twilight switch for controlling operation of the light source.

26. The bed of claim 15, and further comprising a twilight switch for switching on the light source as steady light.

27. A bed, comprising:

a frame having moveable components attached to said bed;

at least one drive for adjusting the components, said drive including a casing;

a control block, secured to an underside of the frame, for the control of the drive, said control block including a circuit board and being disposed at a location selected from the group consisting of inside the casing, mounted externally onto the casing, and separate from the casing; and a light source, connected to an electrically conductive pathway of the circuit board, for radiating downwards and thereby illuminating an area around the frame.

28. The bed of claim 27, and further comprising a luminescent rod juxtaposed to the light source and penetrating through an opening in a wall or lid of the casing for transmitting light rays radiating from the light source.

29. The bed of claim 28, and further comprising a gasket for sealing the luminescent rod in the opening.

30. The bed of claim 28, and further comprising a lens disposed in the opening.

31. The bed of claim 28 wherein the opening has a configuration selected from the group consisting of funnel-shape or truncated cone shape, thereby defining a diameter of greater dimension which faces the circuit board.

32. The bed of claim 27 wherein the frame has a support for a mattress, and further comprising a sensor disposed in the mattress, said light source being operated by the sensor.

33. The bed of claim 32 wherein the sensor is a sensor responding to weight changes.

34. The bed of claim 27 wherein the light source is disposed inside the casing and directly placed onto the electrically conductive pathway of the circuit board.

35. The bed of claim 34 wherein the light source is soldered onto the pathway of the circuit board.

36. The bed of claim 27 wherein the light source is a light-emitting diode.

37. The bed of claim 27, and further comprising a hand switch electrically connected to the circuit board, said light source being operated by the hand switch.

38. The bed of claim 27 wherein the light source is connected in parallel with the drive for adjustment of components of the frame.

39. The bed of claim 27, and further comprising an element selected from the group consisting of photocell and contactless feeler, said light source being switched by the element.

40. The bed of claim 27, and further comprising an electronic circuit for operating the light source with a time delay.

41. The bed of claim 27, and further comprising an electronic circuit for shutting down the light source at a set time delay.

42. The bed of claim 27, and further comprising a twilight switch for controlling operation of the light source.

43. The bed of claim 27, and further comprising a twilight switch for switching on the light source as steady light.

* * * * *